US008631981B2

(12) United States Patent
Zusman

(10) Patent No.: US 8,631,981 B2
(45) Date of Patent: Jan. 21, 2014

(54) HOLSTER AND LOCKING DEVICE

(76) Inventor: Nisim Zusman, Ein Ayala (IL)

( * ) Notice: Subject to any disclaimer, the term of this patent is extended or adjusted under 35 U.S.C. 154(b) by 524 days.

(21) Appl. No.: 12/916,533

(22) Filed: Oct. 30, 2010

(65) Prior Publication Data

US 2011/0101063 A1 May 5, 2011

Related U.S. Application Data

(60) Provisional application No. 61/256,776, filed on Oct. 30, 2009.

(51) Int. Cl.
*F41C 33/04* (2006.01)

(52) U.S. Cl.
USPC ..... 224/244; 224/272; 224/243; 224/912

(58) Field of Classification Search
USPC ..... 224/238, 243–244, 272, 912; 285/67, 285/325; 403/80, 331
See application file for complete search history.

(56) References Cited

U.S. PATENT DOCUMENTS

| | | | |
|---|---|---|---|
| 814,599 | A | 3/1906 | Freyer |
| 837,156 | A | 11/1906 | Townsend |
| 1,295,831 | A | 3/1919 | Alderson |
| 2,347,006 | A | 4/1944 | Tibbetts |
| 2,408,678 | A | 10/1946 | Paley |
| 2,443,397 | A | 6/1948 | Myers |
| 2,455,635 | A | 12/1948 | Witte |
| 2,765,968 | A | 10/1956 | Gaylord |
| 3,008,617 | A | 11/1961 | Villwock |
| 3,128,926 | A | 4/1964 | Stella |
| 3,707,250 | A | 12/1972 | Esposito |
| 3,731,858 | A | 5/1973 | Baker |
| 3,777,952 | A | 12/1973 | Theodore |
| 3,952,930 | A | 4/1976 | Baldocchi |
| 3,977,583 | A | 8/1976 | Bianchi et al. |
| 4,035,902 | A | 7/1977 | Bianchi et al. |
| 4,044,929 | A | 8/1977 | Caruso |
| 4,062,481 | A | 12/1977 | Clark |
| 4,065,039 | A | 12/1977 | Bianchi et al. |
| 4,084,734 | A | 4/1978 | Bianchi et al. |
| 4,101,060 | A | 7/1978 | Bianchi et al. |
| 4,143,798 | A | 3/1979 | Perkins |
| 4,205,768 | A | 6/1980 | Hill et al. |
| 4,218,000 | A | 8/1980 | Mixson |

(Continued)

OTHER PUBLICATIONS

US Army ARDEC Standardization Office, Dimensioning of Accessory Mounting Rail for Small Arms Weapons, MIL-STD-1913, Feb. 3, 1995, SMCAR-BAC-S Picatinny Arsenal, NJ 07806.

*Primary Examiner* — Justin Larson
*Assistant Examiner* — John Cogill
(74) *Attorney, Agent, or Firm* — Law Office of Arthur M. Antonelli, PLLC

(57) ABSTRACT

A handgun holster with an accessory mounting block and a holster locking device are disclosed. The holster locking device may be mounted on the holster. The holster locking device includes a member for securing a rear end of a handgun. The holster locking device includes a frame. The interior surface of the frame may comprise first and second guide members such that the first and second guide members may be disposed in first and second guide grooves in the holster accessory mounting block. Also disclosed is a passage in the frame. A cantilever on the holster accessory mounting block may be disposed in the passage to engage the frame and lock the handgun holster to the holster locking device.

16 Claims, 15 Drawing Sheets

(56) References Cited

U.S. PATENT DOCUMENTS

| | | | | | |
|---|---|---|---|---|---|
| 4,258,871 | A | | 3/1981 | McMahon | |
| 4,270,680 | A | | 6/1981 | Bianchi | |
| 4,277,007 | A | | 7/1981 | Bianchi et al. | |
| 4,286,741 | A | | 9/1981 | Rodgers | |
| 4,494,328 | A | * | 1/1985 | Stevens | 42/115 |
| 4,542,841 | A | | 9/1985 | Bianchi et al. | |
| 4,577,787 | A | | 3/1986 | Hersey | |
| 4,662,552 | A | | 5/1987 | Uyehara | |
| 4,713,889 | A | * | 12/1987 | Santiago | 42/132 |
| 4,741,465 | A | | 5/1988 | Johnson | |
| 4,886,197 | A | | 12/1989 | Bowles et al. | |
| 4,925,075 | A | | 5/1990 | Rodgers | |
| 4,953,769 | A | | 9/1990 | Parsons et al. | |
| D311,277 | S | | 10/1990 | Cupp | |
| 4,966,321 | A | | 10/1990 | Outlaw | |
| 5,018,653 | A | | 5/1991 | Shoemaker | |
| 5,048,682 | A | * | 9/1991 | Taylor | 206/317 |
| 5,054,670 | A | | 10/1991 | Gallagher | |
| 5,100,036 | A | | 3/1992 | Rodgers et al. | |
| D327,367 | S | | 6/1992 | Carrow et al. | |
| D331,497 | S | | 12/1992 | Dixon | |
| 5,174,482 | A | | 12/1992 | Rodgers et al. | |
| 5,209,383 | A | | 5/1993 | Theodore | |
| 5,251,798 | A | | 10/1993 | Theodore | |
| 5,251,799 | A | | 10/1993 | Theodore | |
| 5,265,781 | A | | 11/1993 | Nichols | |
| 5,275,317 | A | | 1/1994 | Rodgers et al. | |
| 5,282,559 | A | | 2/1994 | Wisser et al. | |
| 5,419,472 | A | | 5/1995 | Hellweg et al. | |
| 5,421,497 | A | | 6/1995 | Gilmore | |
| 5,484,093 | A | | 1/1996 | Hellweg et al. | |
| 5,544,794 | A | | 8/1996 | Nichols | |
| D373,242 | S | | 9/1996 | Beletsky | |
| 5,551,610 | A | | 9/1996 | Clifton, Jr. | |
| 5,570,830 | A | | 11/1996 | Nichols | |
| 5,632,426 | A | | 5/1997 | Beletsky et al. | |
| D392,458 | S | | 3/1998 | Batts | |
| 5,865,357 | A | | 2/1999 | Goodwin | |
| 5,875,944 | A | | 3/1999 | Beletsky | |
| 5,918,784 | A | | 7/1999 | Serpa | |
| 5,996,865 | A | | 12/1999 | Bissey | |
| 6,154,997 | A | | 12/2000 | Aluotto et al. | |
| 6,202,908 | B1 | | 3/2001 | Groover | |
| 6,398,089 | B1 | | 6/2002 | Har-Shen | |
| 6,438,888 | B1 | * | 8/2002 | Lin et al. | 42/114 |
| 6,588,635 | B2 | | 7/2003 | Vor Keller et al. | |
| 6,763,984 | B2 | | 7/2004 | Gallagher | |
| 6,769,581 | B2 | | 8/2004 | Rodgers et al. | |
| D501,991 | S | | 2/2005 | Cook et al. | |
| D507,104 | S | | 7/2005 | Gregory et al. | |
| D508,318 | S | | 8/2005 | Gregory et al. | |
| 6,948,644 | B1 | | 9/2005 | Beletsky | |
| D512,561 | S | | 12/2005 | Cook et al. | |
| 7,028,426 | B1 | | 4/2006 | Viani | |
| 7,032,342 | B2 | | 4/2006 | Pikielny | |
| 7,117,625 | B2 | | 10/2006 | Pikielny | |
| D537,624 | S | | 3/2007 | Har-shen | |
| 7,191,556 | B2 | | 3/2007 | Pikielny | |
| 7,216,450 | B2 | | 5/2007 | Pikielny | |
| 7,258,259 | B1 | | 8/2007 | Owens | |
| D567,501 | S | | 4/2008 | Zusman | |
| D568,043 | S | | 5/2008 | Zusman | |
| D574,147 | S | | 8/2008 | Zusman | |
| 7,434,712 | B2 | | 10/2008 | Cook et al. | |
| 7,562,797 | B2 | | 7/2009 | Senn et al. | |
| 7,735,255 | B1 | * | 6/2010 | Kincaid et al. | 42/146 |
| 7,814,698 | B2 | * | 10/2010 | Fluhr et al. | 42/127 |
| 7,816,888 | B2 | * | 10/2010 | Rejman et al. | 320/114 |
| 8,235,263 | B1 | * | 8/2012 | Yeates et al. | 224/243 |
| 2005/0205621 | A1 | * | 9/2005 | Shults | 224/198 |
| 2005/0223614 | A1 | | 10/2005 | Pikielny | |
| 2005/0268518 | A1 | | 12/2005 | Pikielny | |
| 2005/0268519 | A1 | | 12/2005 | Pikielny | |
| 2006/0130386 | A1 | | 6/2006 | Pikielny | |
| 2006/0156609 | A1 | * | 7/2006 | Kim | 42/124 |
| 2006/0236583 | A1 | | 10/2006 | Pikielny | |
| 2007/0017140 | A1 | | 1/2007 | Pikielny | |
| 2007/0084101 | A1 | | 4/2007 | Pikielny | |
| 2007/0175935 | A1 | * | 8/2007 | Clifton, Jr. | 224/243 |
| 2007/0266611 | A1 | * | 11/2007 | Stover | 42/124 |

* cited by examiner

HOLSTER AND LOCKING DEVICE

CROSS REFERENCE TO RELATED APPLICATIONS

This application claims the benefit of U.S. Provisional Application No. 61/256,776, filed on Oct. 30, 2009. U.S. Provisional Application No. 61/256,776 is incorporated by reference herein in its entirety.

FIELD OF THE INVENTION

This invention generally relates to a mechanism for securing an accessory to a holster, and more particularly this invention relates to a holster and a demountable, locking device for the holster. This invention also relates to a method for securing a firearm in a holster, as well as upgrading the security retention capability of a holster.

BACKGROUND

Proper gun handling is essential for safe use. Although no safety mechanism is a substitute for proper gun handling, holster locking devices may be used to reduce the risk of unintended discharge or to deter theft of holstered firearms.

SUMMARY

Hence, the present invention is directed toward a holster and an accessory holster restraint. The present invention is also directed to a holster assembly for securing a rear end of a handgun. The present invention is also directed to a method of adding a handgun removal restraint to a holster to provide three independent mechanisms for securing a handgun in the holster.

One aspect of the present invention relates to a handgun holster comprising a receptacle with an opening that defines a first shape and first volume for the entrance and the exit of a handgun. The receptacle may comprise an accessory mounting block. The accessory mounting block may comprise a base, a recessed accessory mounting surface proximate the base, and a rear accessory stop block adjacent the recessed accessory mounting surface which comprises a locking member that projects over the recessed accessory mounting surface. The locking member may be a resilient cantilever.

The base may comprise a front stop and a mounting platform adjacent the front stop. The mounting platform may comprise an upper surface having a first longitudinal axis, a first side surface having a first guide groove, and a second side surface having a second guide groove. The first and second guide grooves may be aligned with the first longitudinal axis. In addition, the upper surface may be flat and smooth.

The holster may further comprise a screw mechanism for adjusting the first shape of the receptacle such that tightening the screw mechanism reduces the first volume of the receptacle and increases the force necessary to withdraw the handgun from the receptacle. In addition, the holster may comprise a trigger guard retaining mechanism mounted on the receptacle for selectively retaining the handgun in the receptacle.

Another aspect of the present invention is directed to a demountable handgun restraining device for a holster with an accessory mounting block. The demountable handgun restraining device may comprise a frame having a longitudinal axis. The frame may comprise a front end, a rear end, and a holster attachment mechanism. The holster attachment mechanism may comprise a holster attachment structure such that the holster attachment structure connects the frame to the holster, and a holster locking element such that the holster locking element locks the frame to the holster.

The demountable handgun restraining device may further include a retaining member connected to the frame. The retaining member (or cover) may comprise a first wall spaced from the rear end of the frame, and a second wall connected to the first wall and the frame, such that the retaining member is operable between a handgun retaining configuration in which a handgun disposed in the holster is confined between the first wall and the holster, and a handgun release configuration in which a handgun disposed in the holster is unconfined by the first wall.

The retaining member may be pin connected to the frame. Also, the retaining member further may comprise a resilient member which biases the retaining member in handgun release configuration.

The holster attachment mechanism may further comprise a first guide member that is configured and dimensioned to mate with the holster accessory mounting block. In addition, the holster locking element may comprise a passage extending through the frame such that the passage is configured and dimensioned to interlock with the holster accessory mounting block. The holster attachment mechanism may further comprise a second guide member that is configured and dimensioned to mate with the holster accessory mounting block. More particularly, the holster attachment mechanism may be configured and dimensioned to interlock with the holster accessory mounting block in a direction transverse to the longitudinal axis of the frame.

The holster locking device may further comprise a retaining member locking mechanism. The retaining member locking mechanism may comprise a first state in which the retaining member is fixed in the handgun retaining position, and a second state in which the retaining member is not fixed.

The holster locking device may further comprise a user interface connected to the frame and associated with the retaining member locking mechanism. The user interface may comprise a first mode which sets the retaining member locking mechanism in the first state, and a second mode which sets the retaining member locking mechanism in the second state. In addition, the user interface may further comprise a thumb lever operable between first and second thumb lever positions such that in the first thumb lever position the user interface is in the first mode and in the second thumb lever position the user interface is in the second mode.

The holster locking device may further comprise a lever connected to the frame. The lever may be operable between first and second positions such that in the first position the retaining member is in the handgun retaining configuration and in the second position the retaining member is in the handgun release configuration.

Another aspect of the present invention is directed to a holster assembly. The holster assembly may comprise a handgun holster which comprises an accessory mounting block. The holster assembly may further comprise a holster locking device. The holster locking device may comprise a member for securing a rear end of a handgun such that the member is operable between an open position in which the rear end of the handgun is not secured by the member and a closed position in which the rear end of the handgun is secured by the member. The member for securing a rear end of a handgun may comprise a cover. In FIG. 3, the member for securing a rear end of a handgun comprises a cup.

The locking device may further include a frame with a front end and a rear end. The frame may comprise an exterior surface, and an interior surface. The interior surface may comprise first and second guide members such that the first and second guide members are disposed in the first and second guide grooves of the holster accessory mounting block, respectively.

The locking device may further include a passage in the frame extending from the exterior surface to the interior surface. The cantilever of the holster accessory mounting block may be disposed in the frame's passage such that the cantilever engages the frame and locks the first guide member in the first guide groove and locks the second guide members in the second guide groove.

The locking device may further include a member attachment site for connecting the member to the frame, and a member fastening mechanism proximate the rear end of the frame such that in the closed position the cover fastening mechanism is operable between a first state in which the member is fixed to the member fastening mechanism and a second state in which the member is detached from the member fastening mechanism.

Another aspect of the invention is directed to another holster assembly. The other holster assembly may comprise a handgun holster which comprises an accessory mounting block a magazine pouch. The magazine pouch may comprise an opening for the entrance and the exit of a handgun magazine and a holster attachment mechanism.

The holster attachment mechanism may comprise third and fourth guide members such that the magazine pouch may be mounted on the accessory mounting block. The third and fourth guide members may be disposed in the first and second guide grooves of the holster accessory mounting block, respectively. Also, the cantilever on the holster accessory mounting block may engage the holster attachment mechanism to lock the third guide member in the first guide groove and lock the fourth guide member in the second guide groove.

Another aspect of the present invention is directed to a kit which comprises a handgun holster with a holster accessory mounting block and a demountable magazine holster. The demountable magazine holster may comprise a first holster attachment structure such that the first holster attachment structure cooperates with the holster accessory mounting block to selectively secure the demountable magazine holster to the handgun holster. The kit may further comprise a demountable holster locking device adapted to be secured to a holster accessory mounting block. The demountable holster locking device may comprise a second holster attachment structure such that the second holster attachment structure cooperates with the holster accessory mounting block to selectively secure the demountable holster locking device to the handgun holster. The kit may further comprise a holster paddle and a holster belt attachment device.

Another aspect of the present invention is directed to a method of adding a handgun removal restraint to a holster to provide three independent mechanisms for securing a handgun in the holster.

DESCRIPTION OF THE DRAWINGS

The accompanying drawings, which are incorporated herein and constitute part of this specification, illustrate an embodiment of the invention, and together with the general description given above and the detailed description given below, serve to explain the features of the invention.

DETAILED DESCRIPTION OF THE PREFERRED EMBODIMENT

Figure 1:
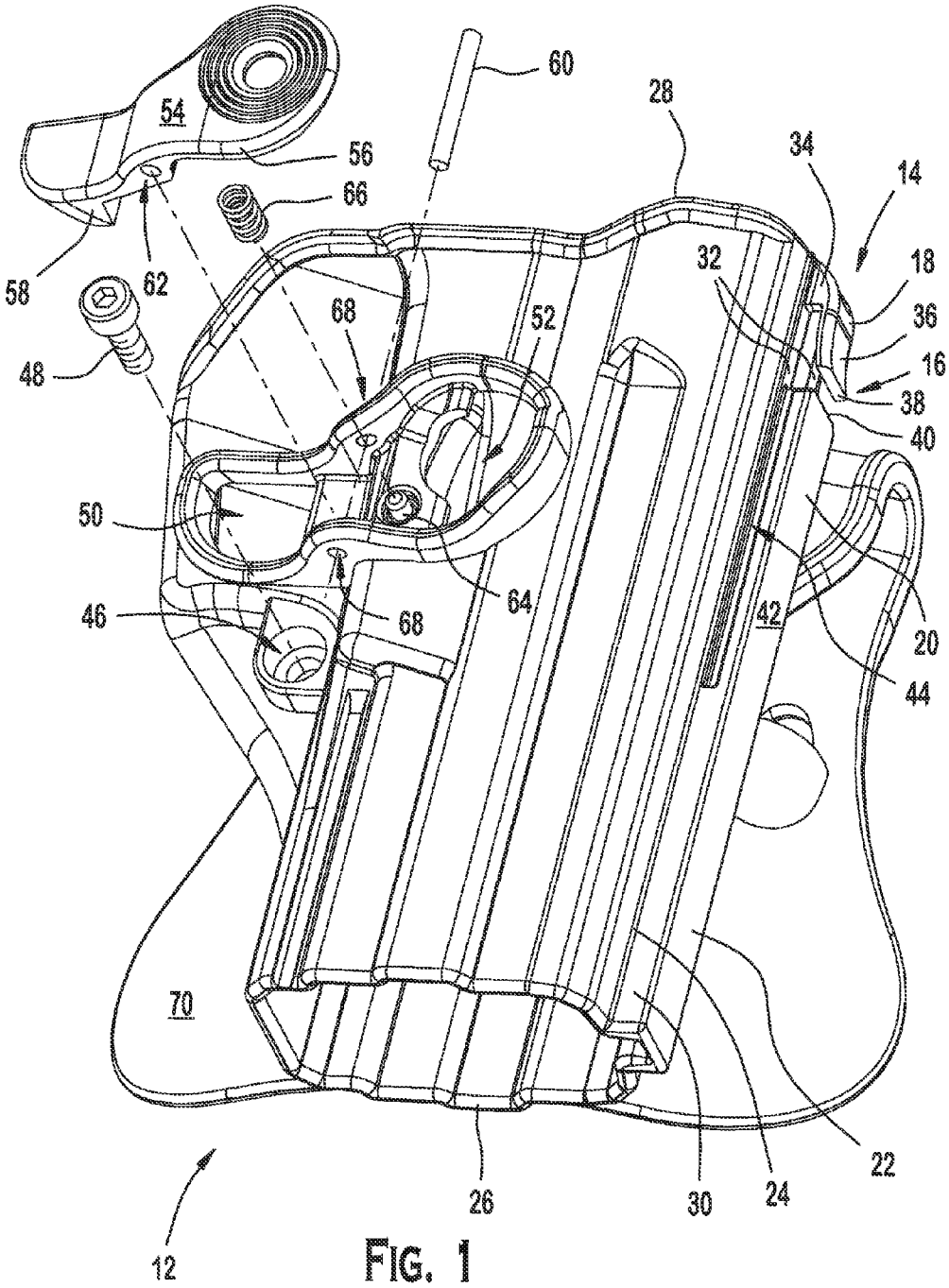
FIG. 1 is a perspective view of an embodiment of a holster of the present invention.

FIG. 1 illustrates an exemplary embodiment of a pistol holster 12 having a holster accessory attachment device 14. The holster accessory attachment device 14 is disposed on the top of the holster 12. It includes an accessory mounting block 16. The accessory mounting block 16 may include a rear accessory stop 18, a front accessory stop 20, and a mounting platform 22.

Additionally, the mounting block may include a base 24 that extends from the front end 26 of the holster to the rear end 28. The lateral extent of the holster accessory platform 22 may be defined by two parallel side surfaces 30. Adjacent the rear end 28 of the base 24 may be one or more recessed accessory mounting surfaces 32. In a preferred embodiment, the two recessed accessory mounting surfaces 32 are spaced away from each other by an opening which extends to the holster interior. Additionally, the recessed accessory mounting surfaces 32 may be perpendicular to the side surfaces 30 of the mounting platform 22. Also, the recessed accessory mounting surfaces 32 may be flat, smooth and rectangular. Proximate the rear end of the recessed accessory mounting surface is a rear accessory stop block 34.

The rear accessory stop block 34 may protrude upward from the base 24. The width of the rear stop block 34 may be less than the width of the recessed mounting platform 22. A top portion of the rear accessory stop block 34 may form a cantilever 36 over the recessed accessory mounting surface 32. The cantilever 36 may curve away from the recessed accessory mounting surface(s) 32 and include a blocking face 38. The cantilever 36 may be resilient, forming a spring mechanism such that downward forces applied to the cantilever 36 are resisted as it is depressed. The cantilever 36 may be lowered in this fashion until it contacts the recessed accessory mounting surfaces. When the downward forces to the cantilever 36 are withdrawn, the cantilever returns to its initial position.

Opposite the rear stop block 34 is the front accessory stop block 40. The front accessory stop block may be formed by a side surface of the mounting platform 22. The top surface of the mounting platform 22 may be disposed at a lower elevation than the blocking face 38 of the cantilever.

The top surface 42 and side walls 30 of the mounting platform 22 may extend from the front stop block 40 to the front of the holster 26. The top surface 42 of the mounting platform may be rectangular, generally flat, and smooth. The side walls 30 of the mounting platform 22 may each possess a front groove 44 having a longitudinal axis parallel to the recessed accessory mounting surface 32. The width of each front groove 44 may be uniform. In one example, the front grooves 44 extend from the front stop block 40 until approximately the mid-point of the mounting platform 22.

Figure 2:
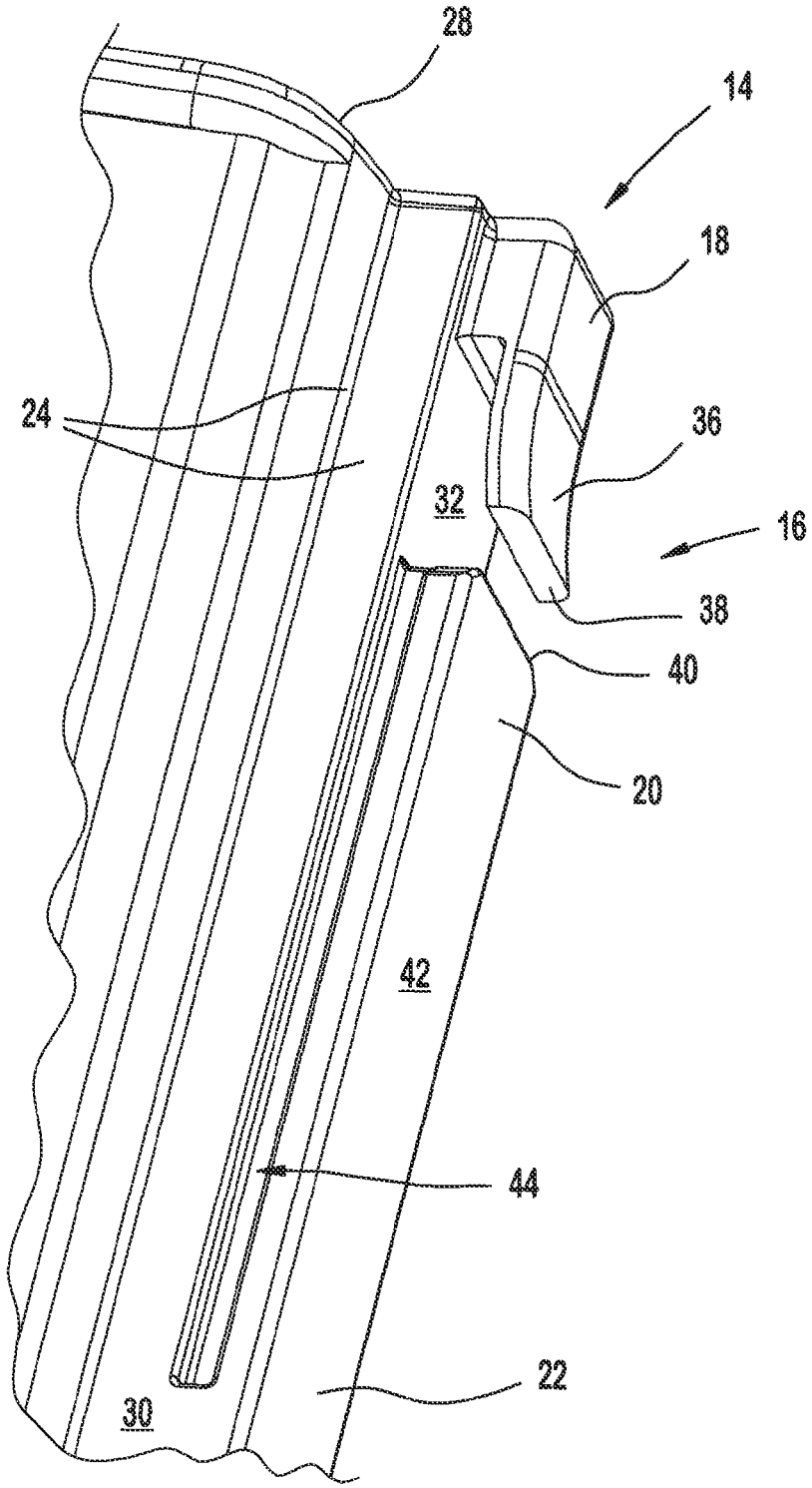
FIG. 2 is a perspective view of another embodiment of the holster accessory device of the holster of FIG. 1.

FIG. 2 presents another embodiment of the holster accessory device 14. In this embodiment, the accessory mounting block 16 is disposed on an extended base 24. Additionally, the rear accessory stop 18 may be a solid member, and the recessed accessory mounting surface may be a generally flat and rectangular surface 32. In this embodiment, the front sight of a pistol entering the holster passes below the rear accessory stop 18 and the recessed accessory mounting surface in their entirety. Also, the front sight of a pistol enters the holster and the front sight groove in the holster receptacle before passing below the rear accessory stop.

Referring to FIG. 1, the holster may include a space 46 for a compression fitting 48 that adjusts the pressure applied to a holstered pistol by the holster walls. Further, the holster may include an opening for a trigger lock 50 and a receptacle 52 for mounting the trigger lock 54. The trigger lock 54 may include a lever arm (or button) 56, a trigger guard blocking member 58, a pivot pin 60, and an attachment site for the pivot pin 62. The receptacle 52 may include a spring mount 64, spring 66, and one or more pivot pin attachment sites 68, which cooperate to secure the trigger lock 54 to the holster and bias the lever arm away from the holster and position the blocking member 58 in the trigger lock opening 50. The holster may include a paddle 70.

Figure 3:
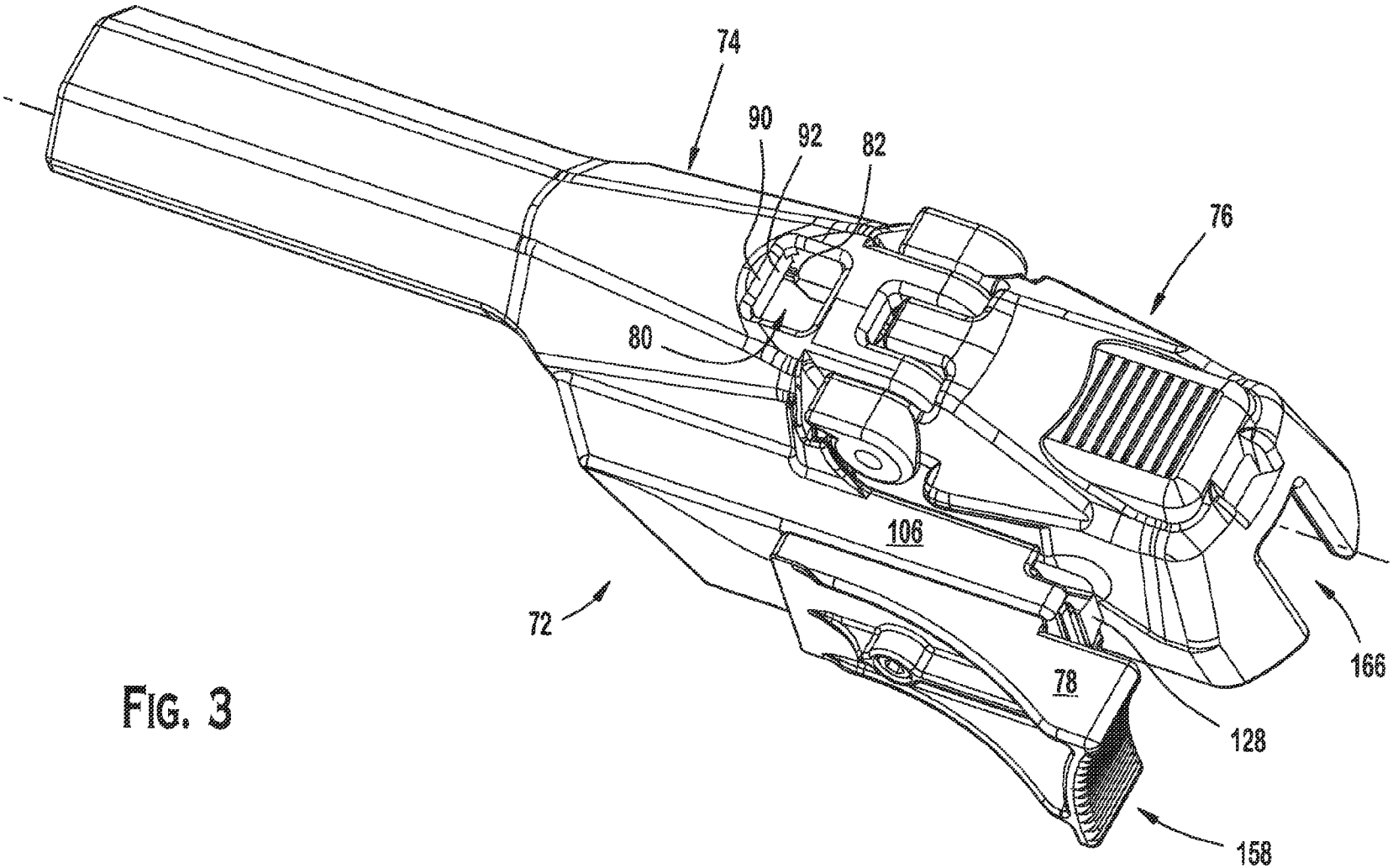
FIG. 3 is a perspective view of an embodiment of a locking device of the present invention.
Figure 4:
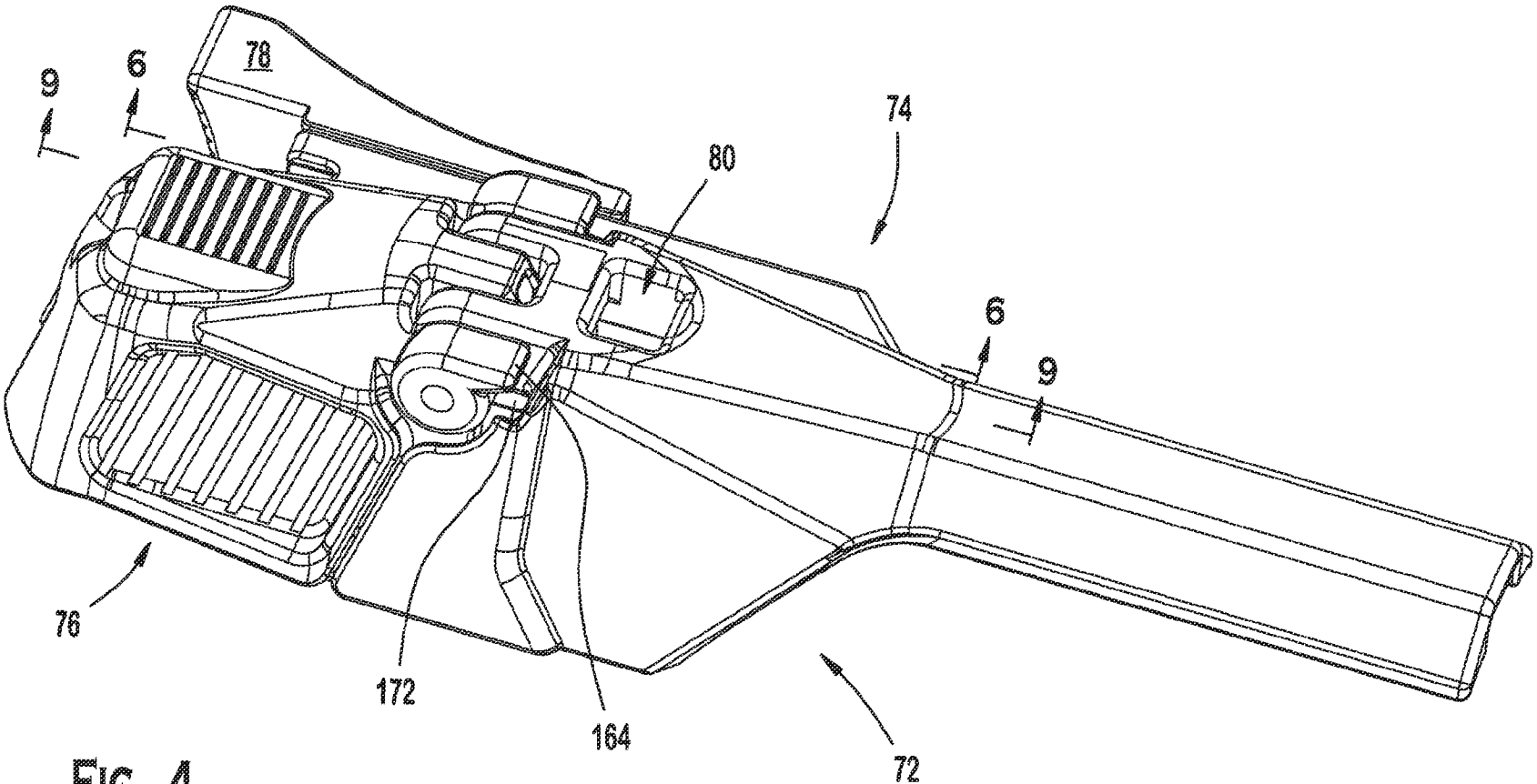
FIG. 4 is another perspective view of the locking device of FIG. 3.

FIGS. 3 and 4 present perspective views of an illustrative embodiment of a holster locking device 72. The holster locking device may include a frame 74, a cover 76 and a cover release lever 78. The frame 74 may include an opening in the frame (or window) 80 and a guide member 82. The cover 76 may be pivotally connected to the frame 74.

Figure 5:
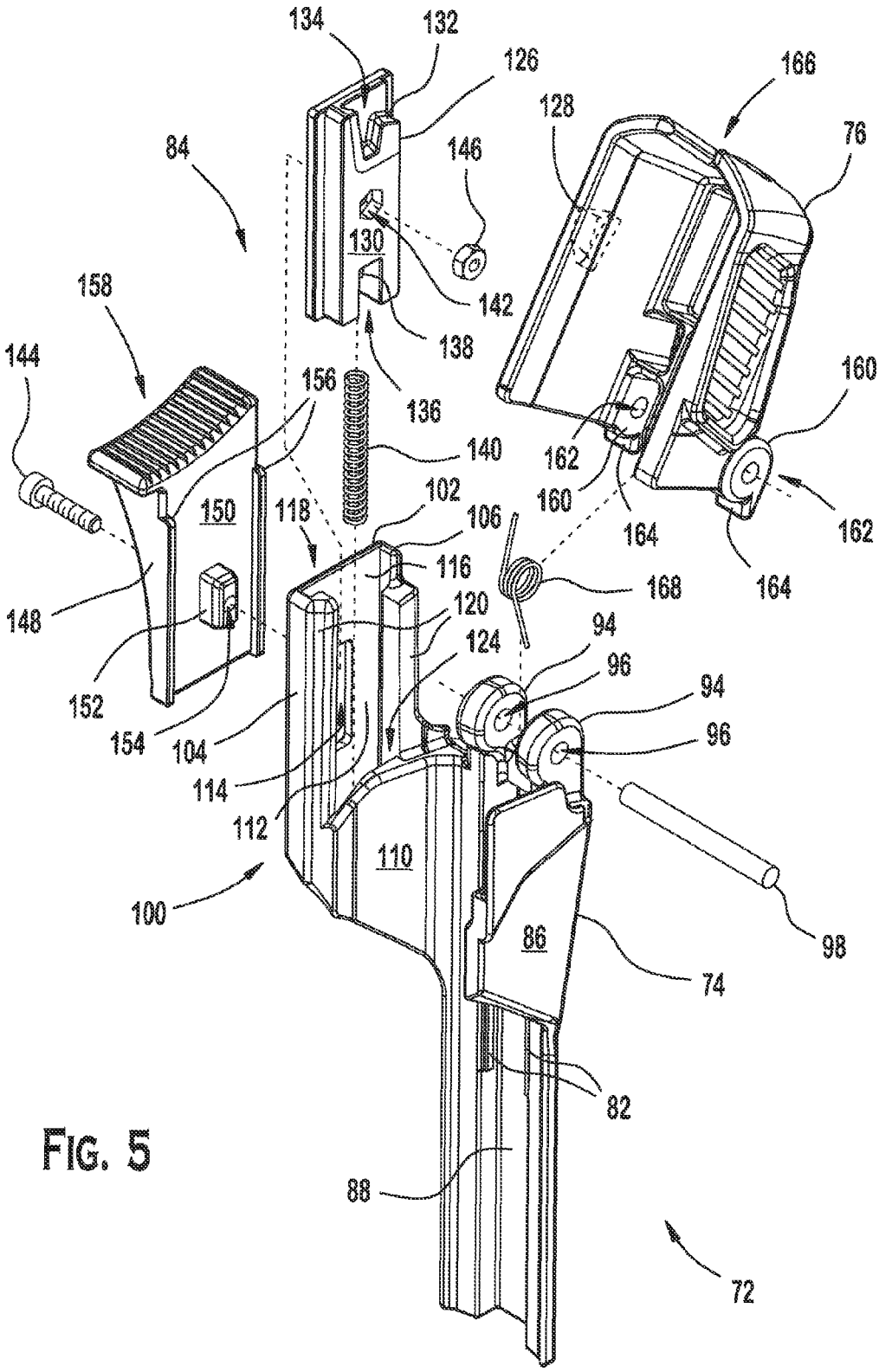
FIG. 5 is an exploded, perspective view of the components of FIG. 3.
Figure 6:
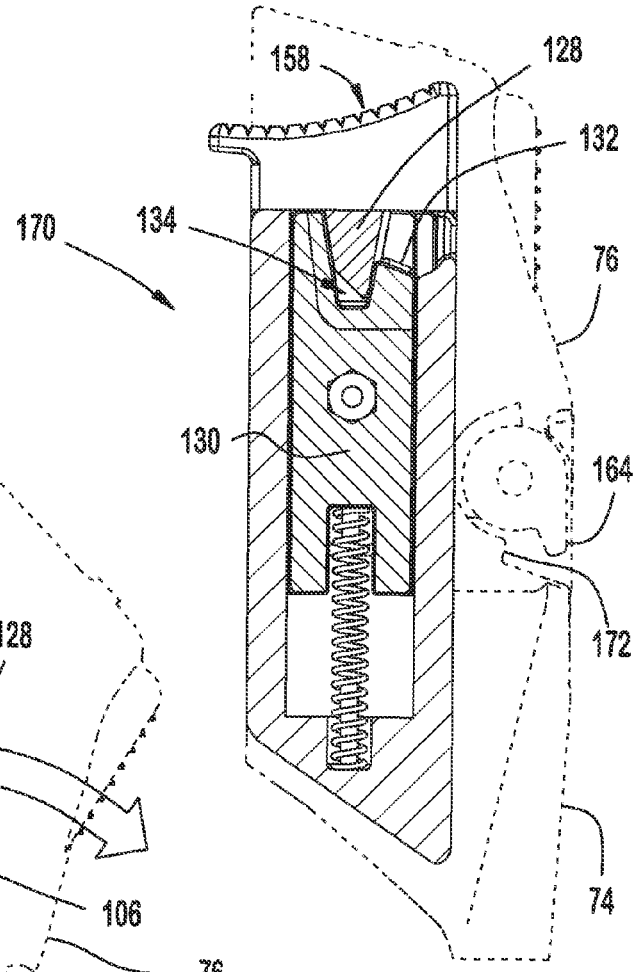
FIG. 6 is a cross-sectional view of the locking device of FIG. 3, along line 6-6, where the actuation member is in an initial position, the locking mechanism is in an activated configuration, the latch member is in a locked state, and the cup is in a closed position.

Referring to FIGS. 5 and 6, the components of the holster locking device 72 may include the frame 74, the cover 76, and the cover latching mechanism 170.

The frame 74 has an outer surface 86 and an inner surface 88. The inner surface 88 of the frame is configured and dimensioned to be slidably received on the multi-mode holster 12. More particularly, a portion of the inner surface 88 is shaped to mate with the accessory mounting block 16. For example, the inner surface 88 of the frame may include two opposing guide members 82. Each guide member 82 may be configured and dimensioned to be slidably received within one of the front grooves 44 on the mounting platform 22.

Figure 9:
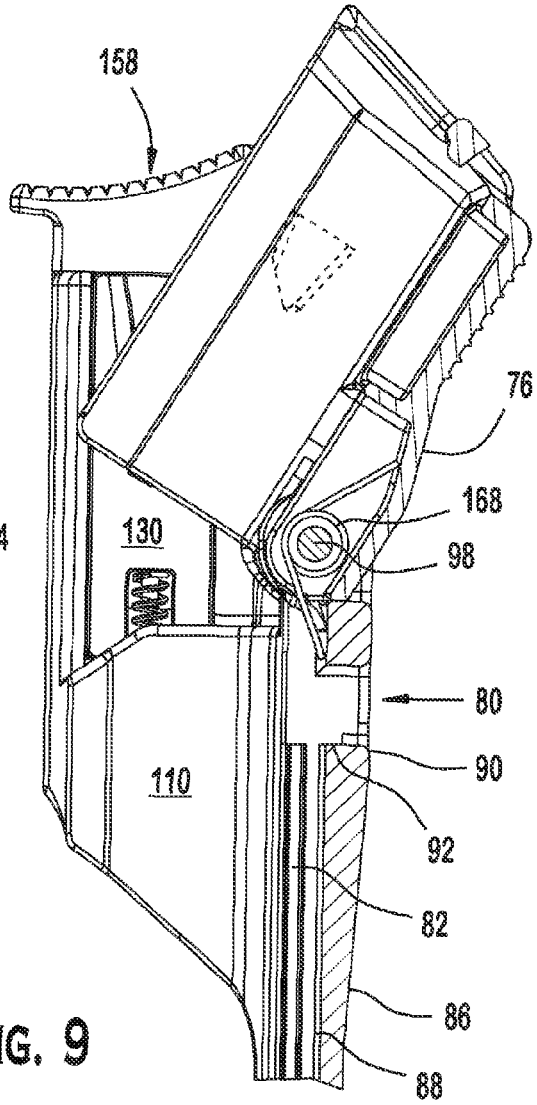
FIG. 9 is a cross-sectional view of the locking device of FIG. 3, along line 9-9, where the actuation member is in the initial state, the locking mechanism is in a deactivated configuration, the latch member is in an unlocked state, and the cover is in the open position.

The frame 74 also may include an opening (or window) 80 that extends from the outer surface 86 to the inner surface 88. Referring to FIGS. 3 and 9, the opening 80 may be defined by a side surface 90 that extends from the outer surface 86 to the inner surface 88. The side surface 90 may include a vertical face 92.

The frame 74 also includes a cover attachment mechanism 94, 96, 98. For example, the cover attachment mechanism may form a hinge with the cover 76. In the embodiment shown in FIG. 3, the frame 74 includes two parallel projections 94. Each projection 94 has a site 96 for securing a pivot pin 98, such as a bore that extends into or through each projection 94. In FIG. 5, each bore is a through hole, and the through holes are sized and aligned to receive the pivot pin 98.

Referring to FIG. 5, the frame 74 may further include a housing 100 for a cover latching mechanism 170 and a cover release mechanism 148. For example, the housing 100 may be located on a rear portion of the frame 74, such that the cover latching mechanism 170 is situated adjacent to the cover 76. In addition, the housing 100 may be disposed between the cover latching mechanism 170 and the cover release mechanism. Further, the housing 100 may be disposed between the holster paddle 70 and the holster 12.

The housing 100 may include an outer wall 102, a lower side wall 104, an upper side wall 106, a front wall 108, and an inner wall 110. The outer wall 102 may include a planar surface 112 and an elongated slot 114 extending from the inner surface 116 to the outer surface 118. The lower and upper side walls each may include a projection 120 that is spaced from and over-hangs the inner surface 116. Referring to FIG. 6, the front wall 108 may extend from the lower side wall 104 to the upper side wall 106 and may further include a bore 122. The inner wall 110 may extend from the lower side wall 104 to the upper side wall 106 to form an enclosure 124 abutting the front wall 108.

The housing 100 may form a bracket with an internal track formed by the planar surface 112 and the lower and upper side walls 104, 106. The latching mechanism 170 may be disposed in the bracket. The latching mechanism 170 may include a catch 126 and a strike 128. For example, the catch 126 may include a plunger member 130 that is keyed to fit into the bracket. Further, the plunger member 130 may be mounted in the bracket for reciprocal movement along the elongated slot 114. Additionally, the plunger member 130 may include a cam surface 132 and a notch 134. The notch 134 may intersect the cam surface 132. The notch 134 may be V-shaped. Also, the plunger member may include a recess 136 with a projection 138 for receiving a spring 140. The plunger member 130 may further include a bore 142 for receiving a fastener 144. The bore 142 may be counter-sunk to receive a nut 146 that secures to the fastener 144.

The release mechanism may be disposed on the outside of the housing 100, and may include an actuation member 148. The actuation member 148 may include a generally planar surface 150 and a rectangular projection 152 disposed on the planar surface 150. The rectangular projection 152 may include a bore 154 which extends from one side of the actuation member 148 to the opposite side. The generally planar surface 150 further may include a pair of parallel rails 156. The actuation member 148 further may include an activation surface 158. The actuation member 148 may be disposed on the outside of the bracket. More particularly, the rectangular projection 152 may be inserted into the elongated slot 114 and secured to the plunger member 130 disposed inside the bracket with a screw 144 and nut 146.

Figure 7:
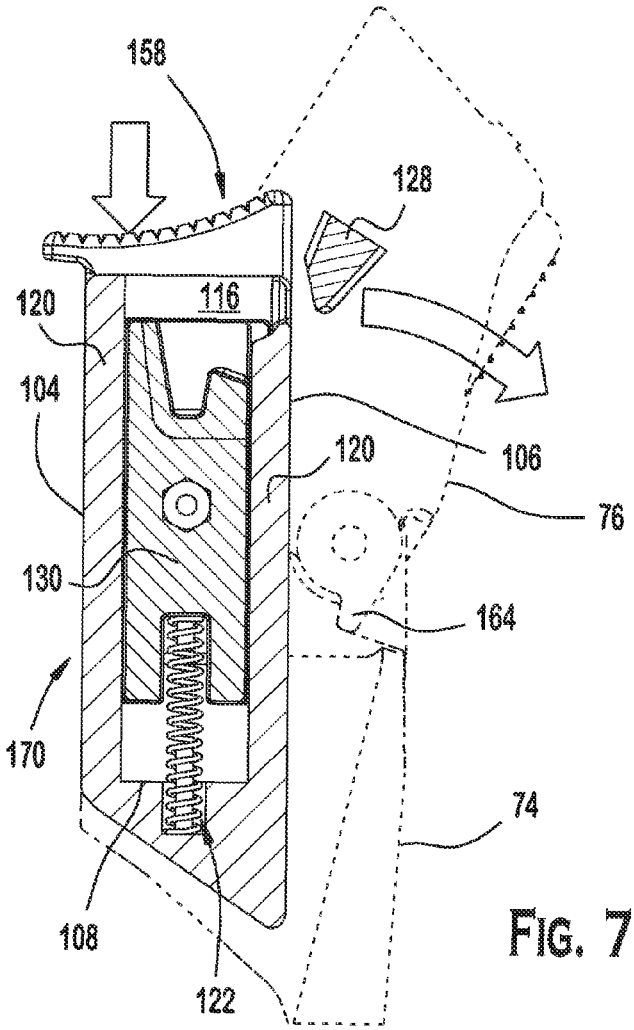
FIG. 7 is a cross-sectional view of the locking device of FIG. 3, along line 6-6, where the actuation member is in a depressed position, the locking mechanism is in a deactivated configuration, the latch member is in an unlocked state, and the cover is in an open position.
Figure 8:
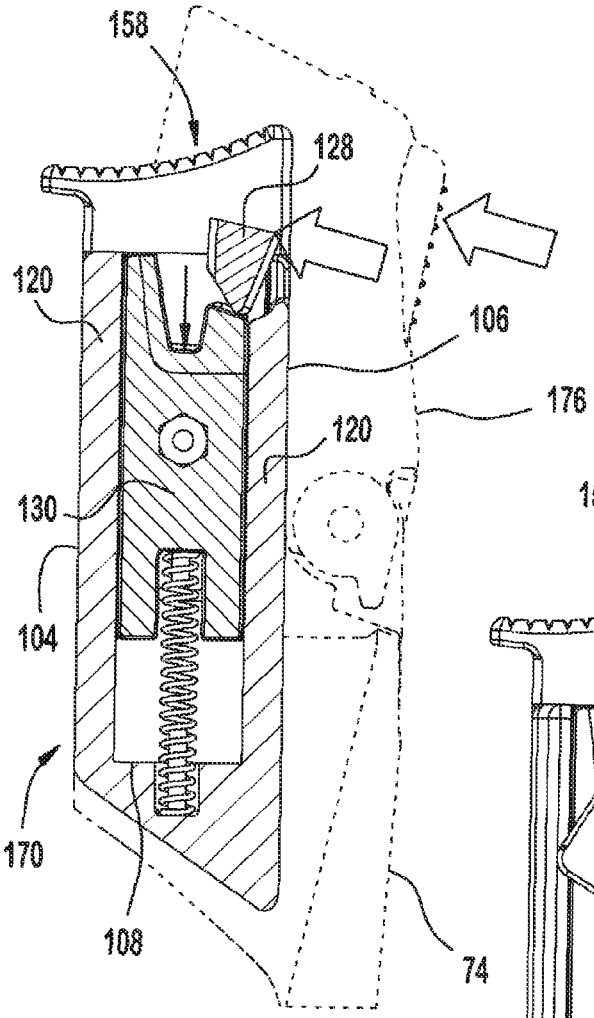
FIG. 8 is a cross-sectional view of the locking device of FIG. 2, along line 6-6, where the actuation member is in the initial position, the locking mechanism is in a loading configuration, the latch member is in an unlocked state, and the cover is in an intermediate position.

Referring to FIGS. 6-8, the latching mechanism 170 may include a spring 140. One end of the spring 140 may be disposed in the notch 122 that is situated in the front wall 108 of the bracket. The other end of the spring 140 may be disposed in the plunger member recess 136.

Referring to FIG. 5, the cover may include three parallel projections 160. Each projection 160 may include a site 162 for securing a pivot pin 98, such as a bore that extends into each projection. For instance, each bore may be a through hole. The three through holes 162 may be sized and aligned to receive and secure the pivot pin 98. The projections further may include a stop 164.

Figure 12:
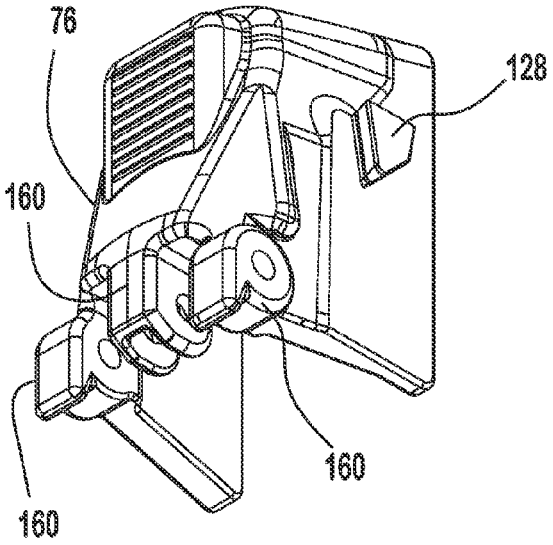
FIG. 12 is a perspective view of the cover of the locking device of FIG. 3.

Referring to FIGS. 5, 9 and 12, one side wall of the cover 76 may include a cut-out 166. Another side wall of the cover may include a stub 128. The stub 128 may be keyed to mate with the notch 134 of the plunger member 130, and thus form a strike for the latching mechanism 170.

The cover 76 may be secured to the frame 74 using a pivot pin 98. For example, two parallel projections 94 on the frame 74 may be interposed with three parallel projections 160 on the cover 76. The interposed projections may be secured by a pin 98 that is inserted into the through holes of the interposed projections to form a hinge.

Figure 10:
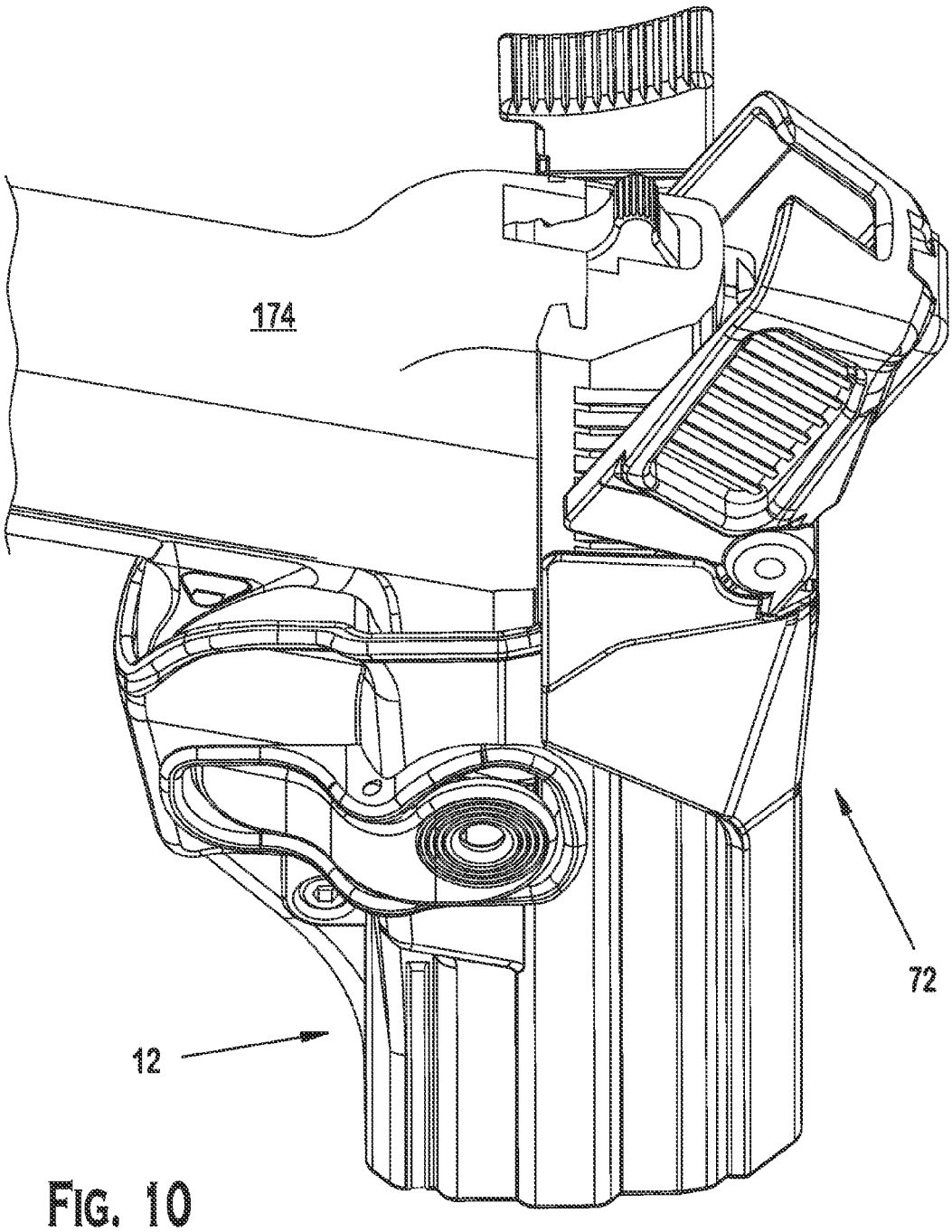
FIG. 10 is a perspective view of the locking device of FIG. 3 attached to the holster of FIG. 1, the locking device being in an unlocked (or open) position.

Referring to FIGS. 5 and 9, 11, 13 a resilient member 168, such as a coil spring or leaf spring, may be placed in the hinge mechanism to bias the cover 76 in an open position with respect to the frame 74. Thus, due to the configuration, dimensions, and material of the resilient member 168, the cover 76 is biased to its initial position, as shown in FIGS. 9 and 10.

The resilient member 168 is preferably manufactured from a metal having resilient properties, such as spring steel or stainless steel. It should be noted that while the resilient member 168 is shown mounted on the pin 98 between the projections 94, it may alternatively be mounted or coupled to the locking device 72 in another manner.

Referring to FIGS. 3 and 5-9, the latching mechanism 170 may cooperate with the stud 128 to form a latch between the cover 76 and the frame 74. For instance, when the cover 76 is in the closed configuration 180 (FIG. 3), the stud 128 is securely disposed in the notch 134 of the spring loaded, plunger member 130.

Referring to FIG. 7, when the activation surface 158 is depressed, the rectangular projection 154 translates within the elongated slot 118, drawing the plunger member 130 away from the stub 128. As the stub 128 and notch 134 separate, the hinge mechanism is free to move from the latched position, and the cover 76 rotates from the closed configuration 180 (FIG. 3) to the open configuration 178 (FIG. 10). Rotation of the cover 76 is arrested, when stops 164 on the cover encounter a blocking surface 172 on the frame 74.

Referring to FIG. 8, as downward force is applied to the rear end of the cover 74, the stub 128 and the cam surface 132 of the plunger member 130 cooperate to push the plunger member against the spring 140 until the stub 128 reengages with the notch 134 on the plunger member 130. After the stub 128 and notch 134 re-engage, the spring 140 biases the plunger member 130 against the stub 128 to interlock the stub 128 and notch 134, and thus latch the cover 76 in the closed configuration 180.

Referring to FIG. 10 the locking device 72 may be configured and adapted to mount on and interlock with the holster 12 to provide a "Level III" security retention system 176 for the holster 12. FIG. 10 is a schematic depiction of the "Level III" security retention system 176 with a pistol 174 in the holster 12 and the locking device 72 being in the unlocked or open position 178.

Figure 11:
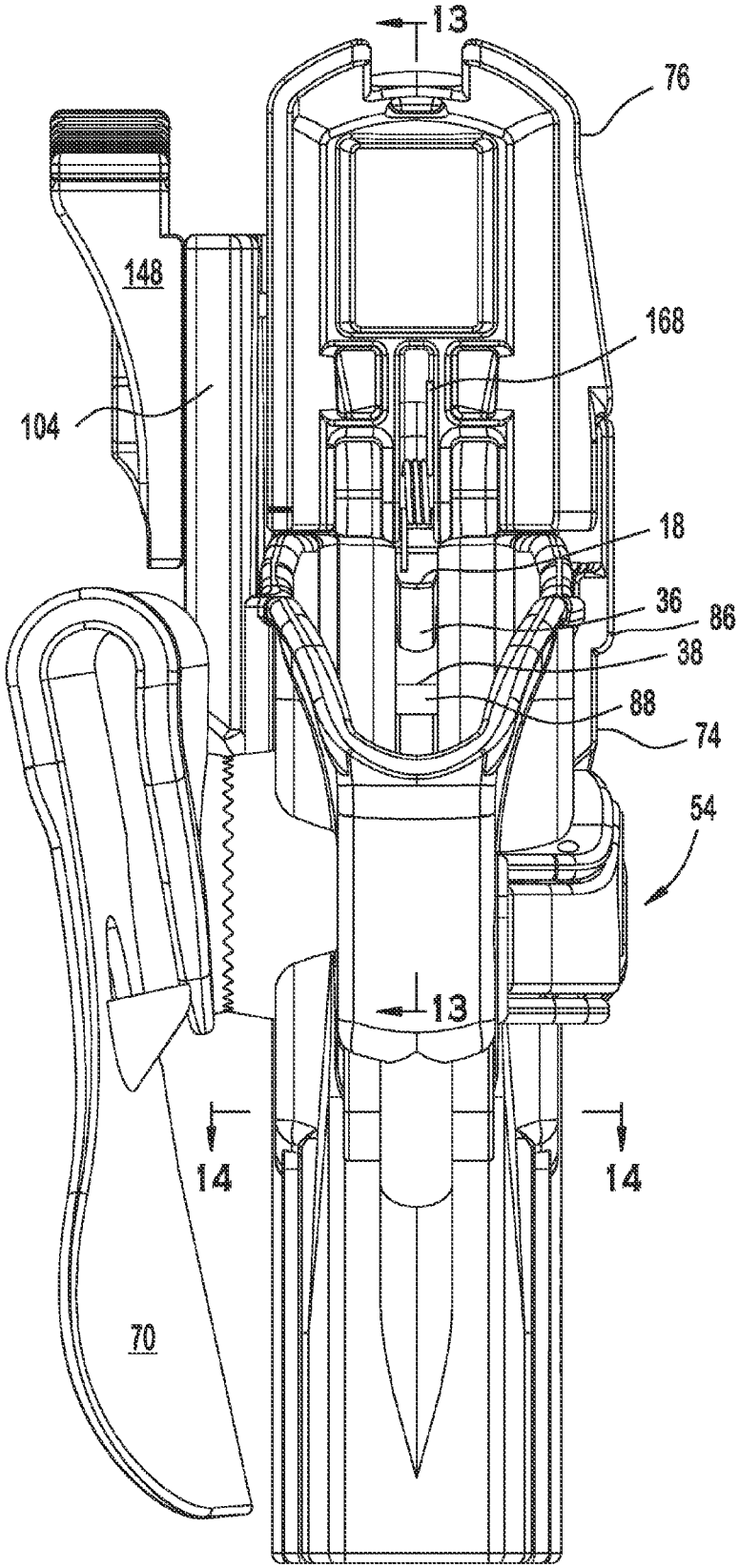
FIG. 11 is a bottom view of the assembly of FIG. 10 in the locked (or closed) position.
Figure 14:
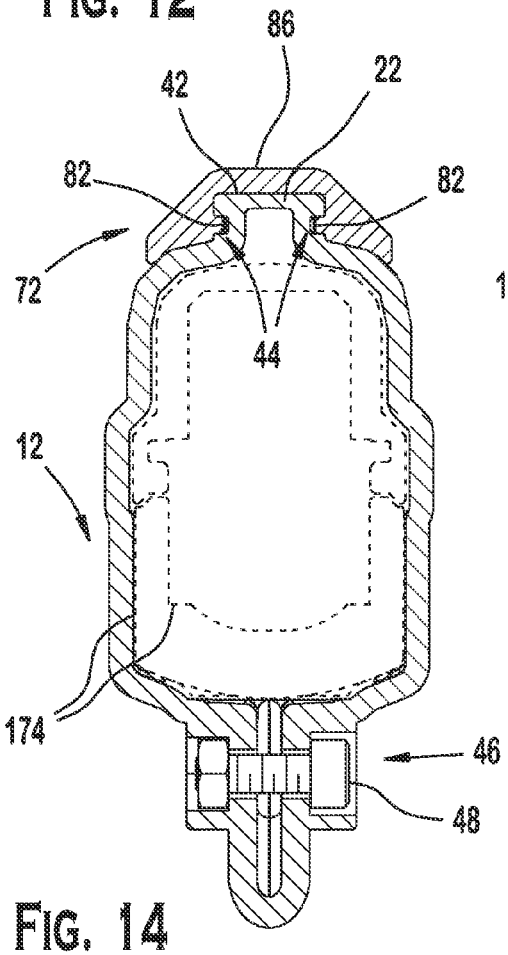
FIG. 14 is a cross-sectional view of the assembly of FIG. 11, along line 14-14.
Figure 13:
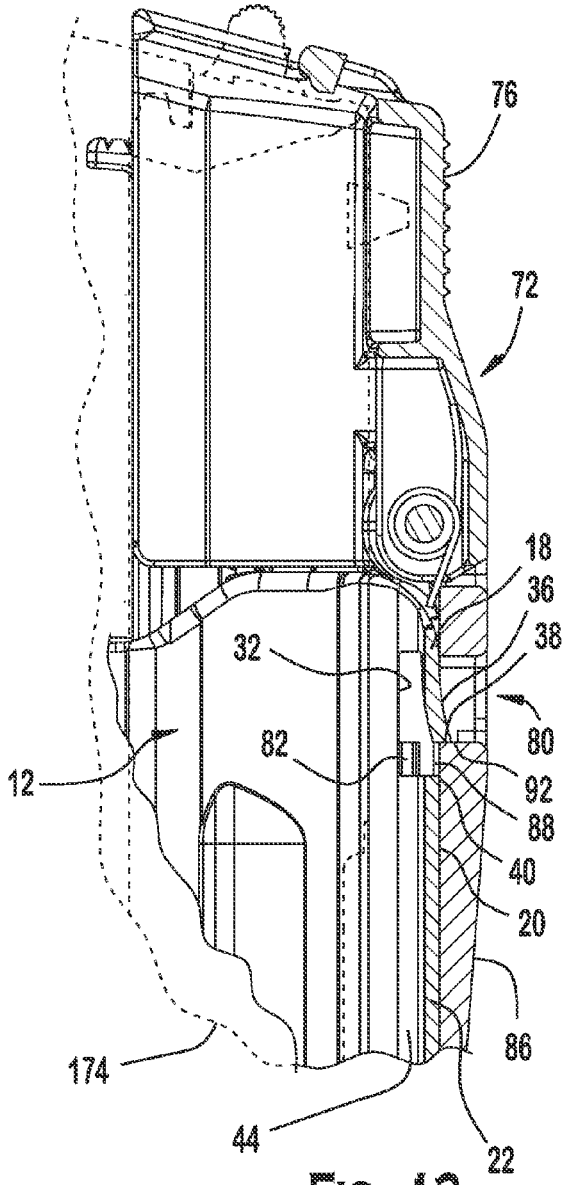
FIG. 13 is a partial cross-sectional view of the assembly of FIG. 11, along line 13-13.

As shown in FIGS. 11, 13 and 14, the guide members 82 on the inner surface of the frame 74 mate with the front grooves 44 of the holster mounting platform 22. In addition the vertical face 92 of the opening in the frame 80 is set against the blocking face 38 of the holster cantilever 36. Thus, the vertical face of the window 80, guide members 82, and the inner surface 88 of the frame 74 and the accessory mounting block 16 of the holster 12, including mounting platform 22 and the blocking face 38 of the cantilever 36 provide a means for securing the locking device to the top of the holster. Other suitable structures and devices, however, may be used to attach the locking device to the holster as long as they secure the locking device to the holster.

To secure the locking device 72 to the holster 12, the cantilever (or resilient tongue) 36 is depressed and the guide members 74 of the frame are fitted into the front grooves 44 of the holster accessory mounting platform 22. The frame 74 is pushed forward until the guide members 82 are fully seated in the front grooves 44 and the cantilever 36 has returned to its initial (or relaxed) position against the vertical face 92 of the opening 80. When the vertical face 92 of the opening 80 and the cantilever 36 are positioned in this matter, the blocking face 38 blocks rearward movement of the frame 74.

To remove the locking device 72 from the holster 12, the cantilever 36 is depressed until the blocking face 38 is below the vertical face 92 of the opening 80. The locking device 72 then may be pulled backward to withdraw the guide members 82 from the front grooves 44.

Figure 15:
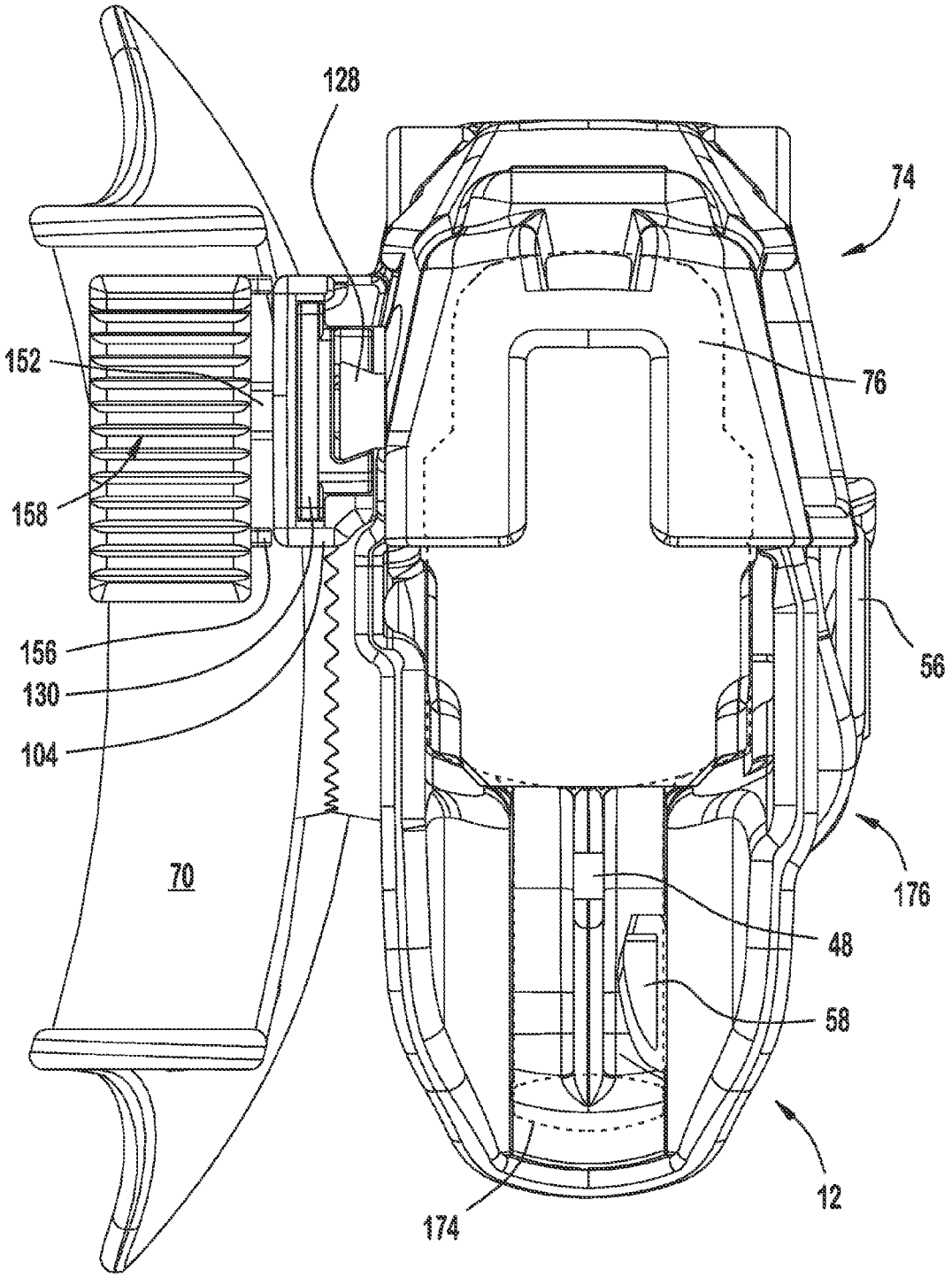
FIG. 15 is a left view of the assembly of FIG. 10.

FIG. 15 shows the three independent restraining devices 48, 58, 76 that act to secure a holstered pistol 174 within the Level III holster assembly 176. In use, a pistol 174 is inserted into the holster 12. The compression fitting 48 may be adjusted to provide the holstered pistol with the desired snugness of fit. Internal to the holster, the holster trigger guard blocking member 58 engages the trigger guard of the pistol, blocking rearward movement of the pistol. The cover 76 is manually lowered by the user into the closed position 82. To withdraw the pistol 174 from the holster 12, the activation surface 158 is depressed to release the latching mechanism 100. The cover 76 pivots open under the spring forces of the hinge mechanism. On the opposite side of the holster, the lever arm 54 of the trigger lock 56 is depressed by the user to disengage the trigger lock blocking member 58 from the pistol's trigger guard. The pistol then may be withdrawn from the holster.

Figure 16:
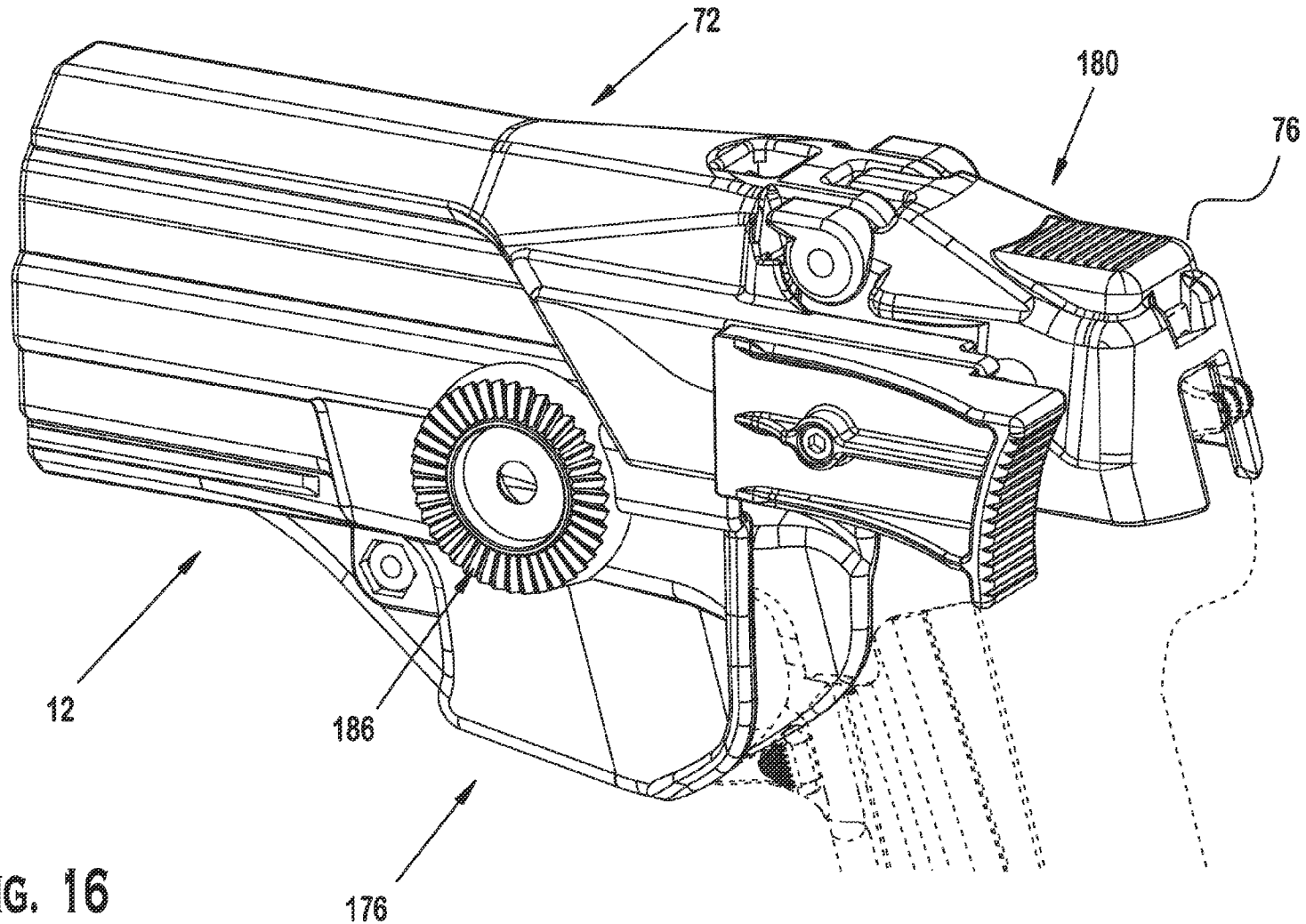
FIG. 16 is perspective view of the assembly of FIG. 5 with the holster paddle removed, the locking device being in the locked (or closed) configuration.
Figure 17:
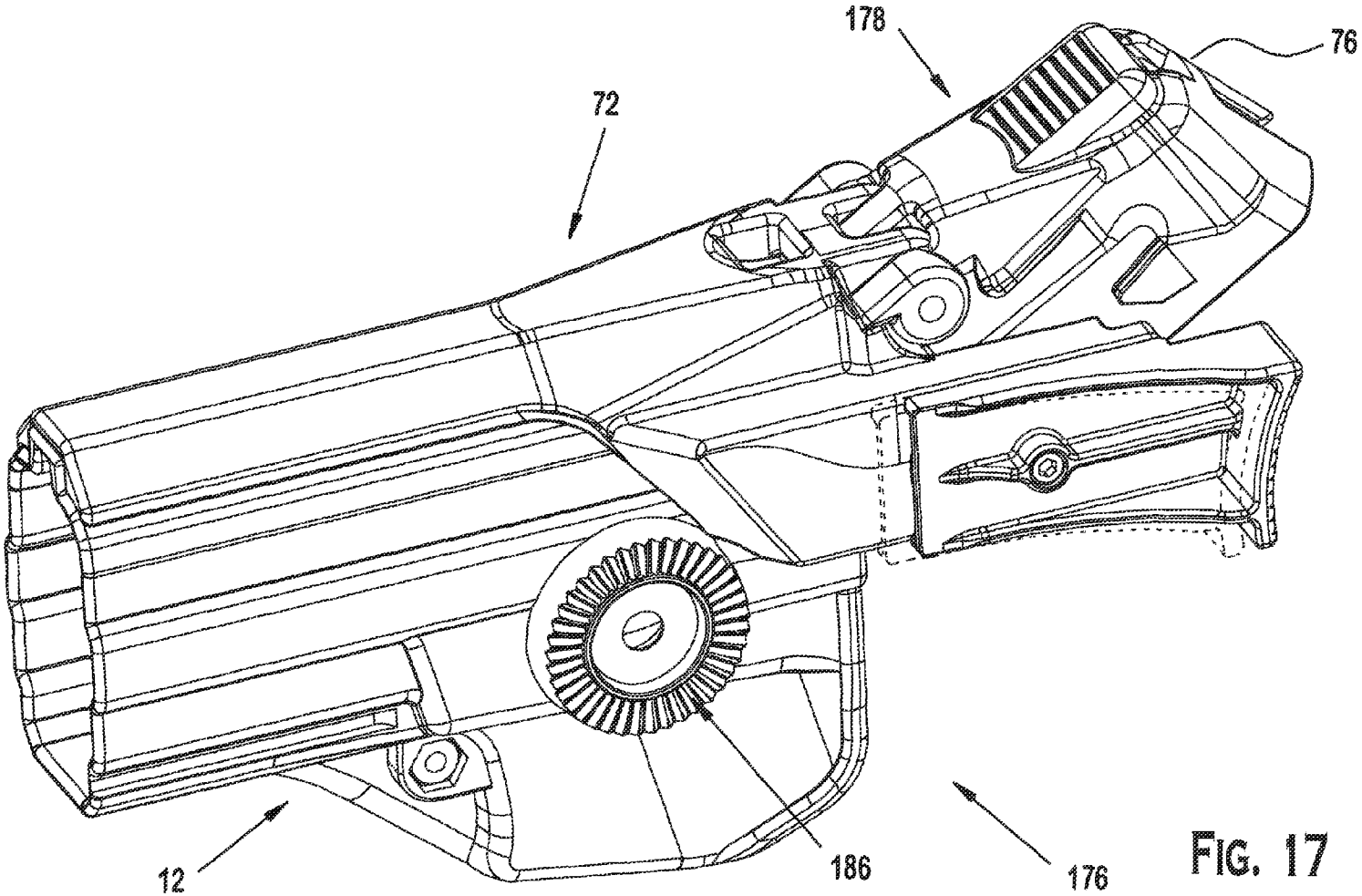
FIG. 17 is a perspective view of the assembly of FIG. 10, the locking device being in the unlocked (or open) configuration.

Referring to FIGS. 16 and 17, the cover 76 is operable between a raised (i.e., open or unlocked) position 178 and a closed (i.e., lowered or locked) position 180. As described above, the cover 76 may be biased toward the open position 178 by the hinge mechanism.

The cover 76 may be closed (i.e., lowered or locked) by rotating the cover 76 into alignment with the frame 74. A cover latching mechanism 170 secures the cover 76 in the closed position 180. A actuation member 148 connected to the latching mechanism 170 is operable from a first position to a second position to release the stub 128. The actuation member 148 may be a thumb lever. In the first position latching mechanism 170 secures the cover 76 in the closed position 180. In the second position 90 the cover release mechanism releases the stub 128, and the cover 76 pivots to the open configuration 178 due to biasing forces from the hinge spring 168. For example, translating the actuation member from the first position to the second position may release the stub 128 and open the cover 76. In another example, rotating an actuation member from a first position to a second position may release the stub 128 and open the cover 76.

Figure 18:
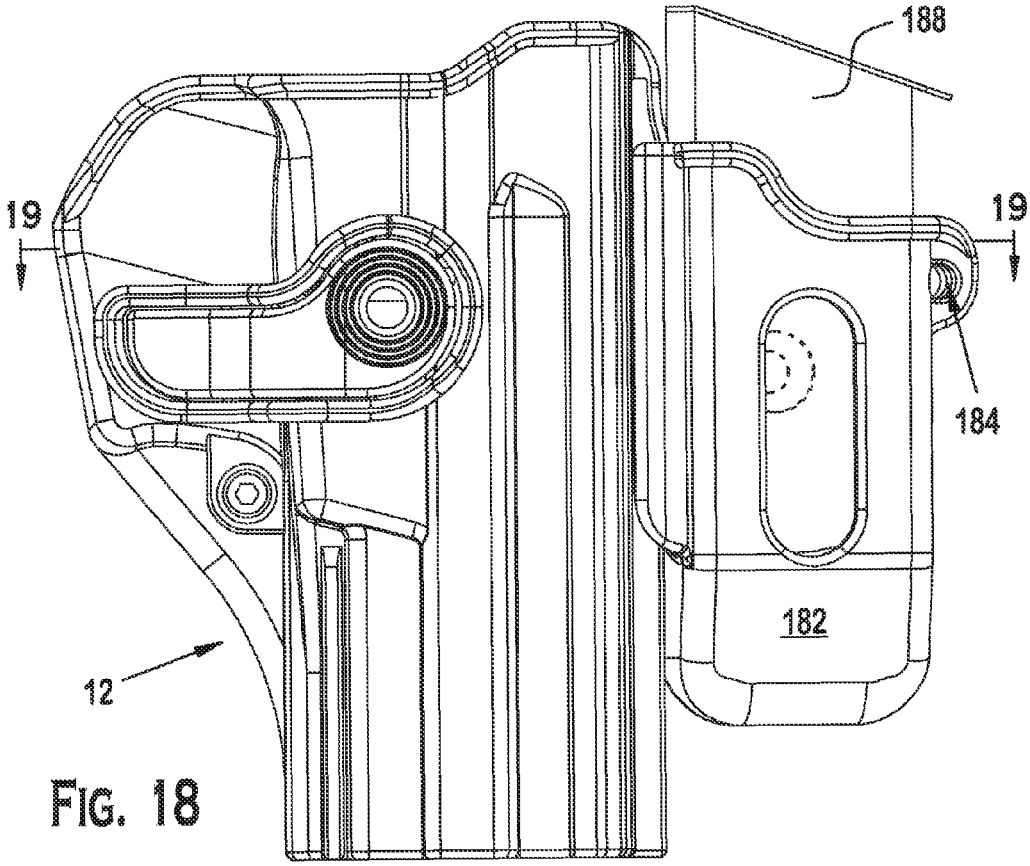
FIG. 18 is a front view of an embodiment of a magazine pouch secured to the holster of FIG. 1.
Figure 19:
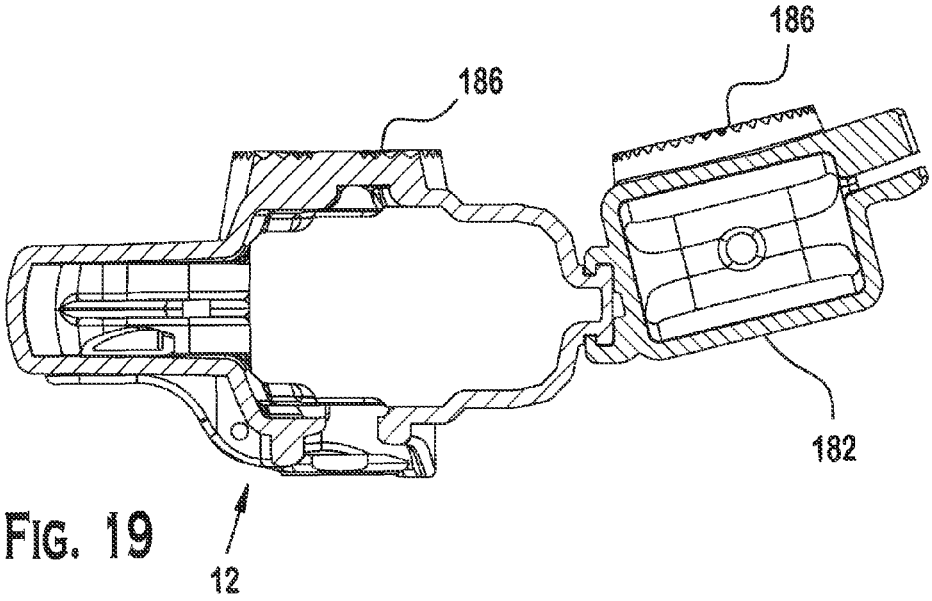
FIG. 19 is a cross-sectional view of the assembly of FIG. 18, along line 19-19.

FIG. 18 is an exemplary magazine holster 94 fitted with a holster attachment mechanism 96 that is configured and adapted to be received on the holster accessory mounting block 16. FIG. 19. is a cross-sectional view of the accessory attachment mechanism 98. In this embodiment, the holster accessory attachment mechanism 98 mates with the holster accessory mounting block 16. The magazine holster may be attached and removed in a similar fashion as the locking device 72.

Referring to FIGS. 10-14 the rear accessory stop 18, front accessory stop 20, and mounting platform 22 provide a means for retaining a holster accessory to the holster, but other suitable structures or devices may be used, as long as a secure and reliable connection with the holster accessory is provided and as long as the attached holster accessory may be selectively demounted from the holster.

Figure 20:
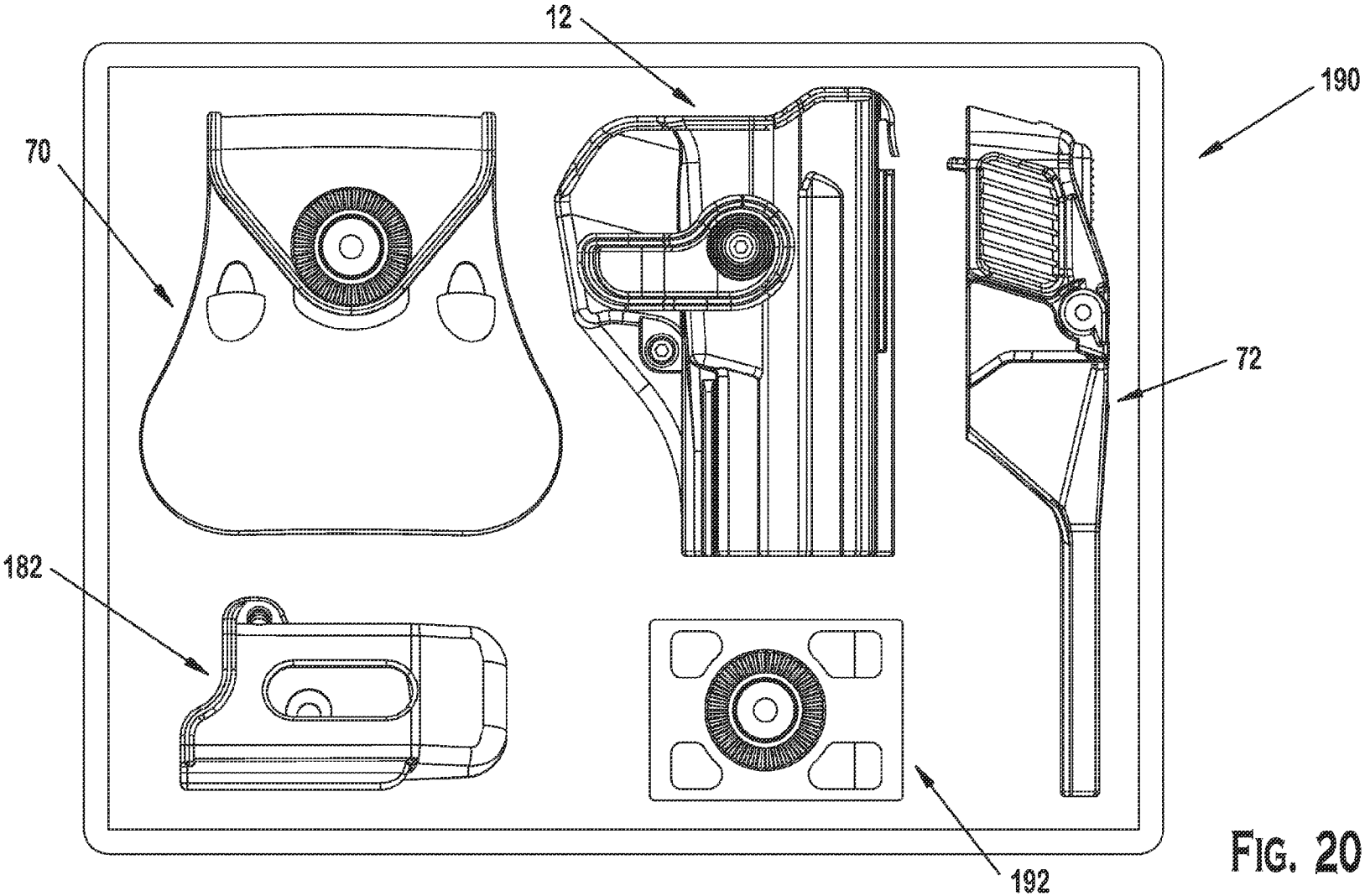
FIG. 20 is a plan view of a kit that includes the holster of FIG. 1 and demountable accessories for use therewith.

Referring to FIG. 20, the holster 12 and the locking device 72 may be packaged in a kit 190. In addition, the kit may include an accessory magazine pouch 182, a holster paddle 70, and a belt holster attachment 192 for use with the holster 12. Thus, for example, a user may affix the belt holster attachment to the holster 12 by removing the paddle 70 from the holster with a wrench (e.g. Allen wrench) included in the kit, and then matching the belt holster attachment to the holster paddle attachment site 186. The user may then adjust the cant of the holster 12 with respect to the belt holster attachment and secure the holster and belt holster attachment with the Allen wrench. The kit also may include directions for interchanging accessories in the kit with the holster 12.

In addition, components of the Level III holster assembly (e.g. frame and cover), magazine holster, and belt holster attachment may be fabricated by injection molding a high strength, heat and corrosion resistant polymer, which has a relatively high hardness, such as but not limited to, nylon 6/6.

While it has been illustrated and described what are at present considered to be preferred embodiments and methods of the present invention, it will be understood by those skilled in the art that various changes and modifications may be made, and equivalents may be substituted for elements thereof without departing from the true scope of the invention.

For instance, one of ordinary skill in the art can appreciate that the activation mechanism can alternatively be coupled or connected to the housing in another manner, such as in a pivotal, rotatable or cantilevered fashion. For example, the activation mechanism can be a linkage system or formed of two members, where one member is slidably coupled to the housing and the other member pivots.

Accordingly, many modifications may be made to adapt a particular element, technique or implementation to the teachings of the present invention without departing from the central scope of the invention. Therefore, it is intended that this invention not be limited to the particular embodiments and methods disclosed herein, but that the invention include all embodiments falling within the scope of the appended claims.

What is claimed is:

1. A holster for a handgun having a front sight comprising:

a receptacle with an opening that defines a first shape and first volume for the entrance and the exit of a handgun; and an accessory mounting block that comprises a mounting platform which comprises an upper surface having a first longitudinal axis, a first side surface which comprises a first guide groove, the first guide groove being aligned with the first longitudinal axis, a recessed accessory mounting surface proximate the mounting platform, and a rear accessory stop adjacent the recessed accessory mounting surface, which comprises a lower portion, a cantilever projecting over the recessed accessory mounting surface, and a passage extending through the lower portion, the passage being open to the first volume such that the passage allows a front sight of a handgun to slide through the lower portion and under the cantilever as the handgun is holstered.

2. The holster of claim 1, wherein the cantilever is curved and resilient and comprises a blocking face, and the blocking face is disposed at a first elevation relative to the recessed accessory mounting surface, and the top surface of the mounting platform is disposed at a second elevation relative to the recessed accessory mounting surface, and the first elevation is greater than the second elevation.

3. The holster of claim 1, wherein mounting platform further comprises a second side surface and a second guide groove disposed in the second side surface and wherein the first and second guide grooves extend from the front stop block until approximately the mid-point of the mounting platform.

4. The holster of claim 1, further comprising a trigger guard retaining mechanism mounted on the receptacle for selectively retaining the handgun in the receptacle.

5. The holster of claim 1, further comprising a screw mechanism for adjusting the first shape of the receptacle such that tightening the screw mechanism reduces the first volume of the receptacle and increases the force necessary to withdraw the handgun from the receptacle.

6. A holster for a handgun having a front sight comprising:

a receptacle with an opening that defines a first shape and first volume for the entrance and the exit of a handgun; and an accessory mounting block that comprises a front accessory stop, an adjacent mounting platform which comprises an upper surface having a first longitudinal axis, a first side surface which comprises a first guide groove, and a second side surface which comprises a second guide groove, the first and second guide grooves being aligned with the first longitudinal axis, a recessed accessory mounting surface proximate the front accessory stop, and a rear accessory stop adjacent the recessed accessory mounting surface, the rear accessory stop including an upper portion which comprises a curved cantilever that projects over the recessed accessory mounting surface, wherein the rear accessory stop comprises a passage open to the first volume such that the passage allows the front sight of the handgun to slide through the passage as the handgun is holstered.

7. The holster of claim 6, further comprising a screw mechanism for adjusting the first shape of the receptacle such that tightening the screw mechanism reduces the first volume of the receptacle and increases the force necessary to withdraw the handgun from the receptacle.

8. The holster of claim 7, wherein a trigger guard retaining mechanism is mounted on the receptacle for selectively retaining the handgun in the receptacle.

9. A holster assembly comprising:

a handgun holster of claim 6, and a holster locking device which comprises a member for securing a rear end of a handgun such that the member is operable between an open position in which the rear end of the handgun is not secured by the member and a closed position in which the rear end of the handgun is secured by the member, a frame with a front end and a rear end, the frame including an exterior surface, and an interior surface that comprises first and second guide members such that the first and second guide members are disposed in the first and second guide grooves, respectively, a passage in the frame extending from the exterior surface to the interior surface, the cantilever being disposed in the passage such that the cantilever engages the frame and locks the first guide member in the first guide groove and locks the second guide member in the second guide groove;

a member attachment site for connecting the member to the frame; and a member fastening mechanism proximate the rear end of the frame such that in the closed position the cover fastening mechanism is operable between a first state in which the member is fixed to the member fastening mechanism and a second state in which the member is detached from the member fastening mechanism.

10. The holster assembly of claim 9, wherein the member for securing a rear end of a handgun comprises a polymer cup.

11. A kit comprising: a handgun holster of claim 6, a demountable magazine holster having a first holster attachment structure such that the first holster attachment structure cooperates with the holster accessory mounting block to selectively secure the demountable magazine holster to the handgun holster; and a demountable holster locking device adapted to be secured to a holster accessory mounting block, the demountable holster locking device having a second holster attachment structure such that the second holster attachment structure cooperates with the holster accessory mounting block to selectively secure the demountable holster locking device to the handgun holster.

12. The kit of claim 11, further comprising: a holster paddle; and a holster belt attachment device.

13. The holster of claim 6, wherein the cantilever is resilient.

14. The holster of claim 6, wherein the cantilever comprises a blocking face that opposes the front accessory stop and the blocking face is disposed at a first elevation relative to the recessed accessory mounting surface, and the upper surface of the mounting platform is disposed at a second elevation relative to the recessed accessory mounting surface, and the first elevation is greater than the second elevation.

15. The holster of claim 6, wherein the upper surface of the mounting platform is smooth.

16. A holster assembly comprising: a handgun holster of claim 6, and a magazine pouch with an opening for the entrance and the exit of a handgun magazine; the magazine pouch including a holster attachment mechanism that comprises third and fourth guide members such that the magazine pouch is mounted on the accessory mounting block, the third and fourth guide members are disposed in the first and second guide grooves, respectively, and the cantilever engages the holster attachment mechanism to lock the third guide member in the first guide groove and lock the fourth guide member in the second guide groove.

* * * * *